US011905973B2

(12) United States Patent
Chen et al.

(10) Patent No.: US 11,905,973 B2
(45) Date of Patent: Feb. 20, 2024

(54) FAN ASSEMBLY

(71) Applicants: MICRO-STAR INT'L CO., LTD., New Taipei (TW); MSI COMPUTER (SHENZHEN) CO., LTD., Shenzhen (CN)

(72) Inventors: Yi Wen Chen, New Taipei (TW); Yung Ching Huang, New Taipei (TW); Shang-Chih Yang, New Taipei (TW)

(73) Assignees: MICRO-STAR INT'L CO., LTD., New Taipei (TW); MSI COMPUTER (SHENZHEN) CO., LTD., Shenzhen (CN)

( * ) Notice: Subject to any disclaimer, the term of this patent is extended or adjusted under 35 U.S.C. 154(b) by 0 days.

(21) Appl. No.: 17/846,854

(22) Filed: Jun. 22, 2022

(65) Prior Publication Data

US 2023/0358254 A1 Nov. 9, 2023

(30) Foreign Application Priority Data

May 4, 2022 (TW) ..... 111116821
May 4, 2022 (TW) ..... 111204566

(51) Int. Cl.

| | |
|---|---|
| ***F04D 29/66*** | (2006.01) |
| ***F04D 29/52*** | (2006.01) |
| ***F04D 19/00*** | (2006.01) |
| ***F04D 29/32*** | (2006.01) |

(52) U.S. Cl.

CPC ..... *F04D 29/663* (2013.01); *F04D 19/002* (2013.01); *F04D 29/326* (2013.01); *F04D 29/522* (2013.01); *F04D 29/526* (2013.01); *F04D 29/329* (2013.01)

(58) Field of Classification Search

CPC .... F04D 29/663; F04D 19/002; F04D 29/326; F04D 29/522; F04D 29/526; F04D 29/329

See application file for complete search history.

(56) References Cited

FOREIGN PATENT DOCUMENTS

| | | | | |
|---|---|---|---|---|
| CN | 216561683 U | * | 5/2022 | |
| DE | 102021203788 A1 | * | 10/2022 | |
| EP | 2644898 A1 | * | 10/2013 | ..... F04D 17/025 |

OTHER PUBLICATIONS

Machine Translation of EP2644898A1 PDF file name: "EP2644898A1_Machine_Translation.pdf".*

(Continued)

*Primary Examiner* — Grant Moubry
*Assistant Examiner* — Ruben Picon-Feliciano
(74) *Attorney, Agent, or Firm* — Maschoff Brennan

(57) ABSTRACT

A fan assembly including a fan frame and an impeller. The fan frame includes a frame body and a first peripheral protruding plate and has an air inlet and an air outlet. The first peripheral protruding plate protrudes from a side of the frame body and forms an air channel together with the frame body. The first peripheral protruding plate is configured to reduce a noise made by the fan assembly. The air inlet is in fluid communication with the air outlet via the air channel. The impeller is rotatably disposed on the frame body and located in the air channel. The protruding height of the first peripheral protruding plate relative to the frame body ranges from 50 to 100 percent of an overall axial thickness of the impeller.

10 Claims, 4 Drawing Sheets

(56) References Cited

OTHER PUBLICATIONS

Machine Translation of CN216561683U PDF file Name: "CN216561683U_Machine_Translation.pdf".*
Machine Translation of DE102021203788A1 PDF File Name: "DE102021203788A1_Machine_Translation.pdf".*

* cited by examiner

FAN ASSEMBLY

CROSS-REFERENCE TO RELATED APPLICATIONS

This non-provisional application claims priority under 35 U.S.C. § 119(a) on Patent Application No(s). 111116821 filed in Taiwan, R.O.C. on May 4, 2022, and on Patent Application No(s). 111204566 filed in Taiwan, R.O.C. on May 4, 2022, the entire contents of which are hereby incorporated by reference.

TECHNICAL FIELD

The disclosure relates to a fan assembly, more particularly to a fan assembly including at least one peripheral protruding plate configured to reduce a noise made by the fan assembly.

BACKGROUND

Since a graphics card generates a large amount of heat during operation, the graphics card usually includes one or more fans to efficiently dissipate the generated heat. In general, the one or more fans is disposed on a circuit board of the graphics card via a fan frame.

However, conventionally, an air inlet of the fan frame is flush with an outer surface of the fan frame. Thus, a heat dissipation airflow blown by the fan can hardly enter into the air inlet smoothly. In this way, an inlet air volume and an outlet air volume of the fan assembly are reduced, and thus a fan speed of the fan is required to be increased to increase the inlet air volume and the outlet air volume, which causes the fan assembly to make louder noise.

SUMMARY

The disclosure provides a fan assembly with increased inlet air volume and increased outlet air volume, such that the desired inlet air volume and desired outlet air volume are allowed to be maintained while reducing the fan speed of the fan, thereby reducing the noise made by the fan assembly.

One embodiment of this disclosure provides a fan assembly including a fan frame and an impeller. The fan frame includes a frame body and a first peripheral protruding plate and has an air inlet and an air outlet. The first peripheral protruding plate protrudes from a side of the frame body and forms an air channel together with the frame body. The first peripheral protruding plate is configured to reduce a noise made by the fan assembly. The air inlet is located at a side of the first peripheral protruding plate located farthest away from the frame body. The air outlet is located at a side of the frame body located farthest away from the first peripheral protruding plate. The air inlet is in fluid communication with the air outlet via the air channel. The impeller is rotatably disposed on the frame body and located in the air channel. The protruding height of the first peripheral protruding plate relative to the frame body ranges from 50 to 100 percent of an overall axial thickness of the impeller.

According to the fan assembly disclosed by the above embodiments, since the protruding height of the first peripheral protruding plate relative to the fan frame ranges from 50 to 100 percent of the overall axial thickness of the impeller, and the air inlet is located on the side of the first peripheral protruding plate that is located farthest away from the frame body, the inlet air volume and the outlet air volume of the fan assembly are increased. Accordingly, the fan assembly is allowed to used lower fan speed to reach the desired inlet air volume and the desired outlet air volume, thereby reducing the noise made by the fan assembly.

BRIEF DESCRIPTION OF THE DRAWINGS

The present disclosure will become better understood from the detailed description given herein below and the accompanying drawings which are given by way of illustration only and thus are not intending to limit the present disclosure and wherein.

DETAILED DESCRIPTION

Figure 1:
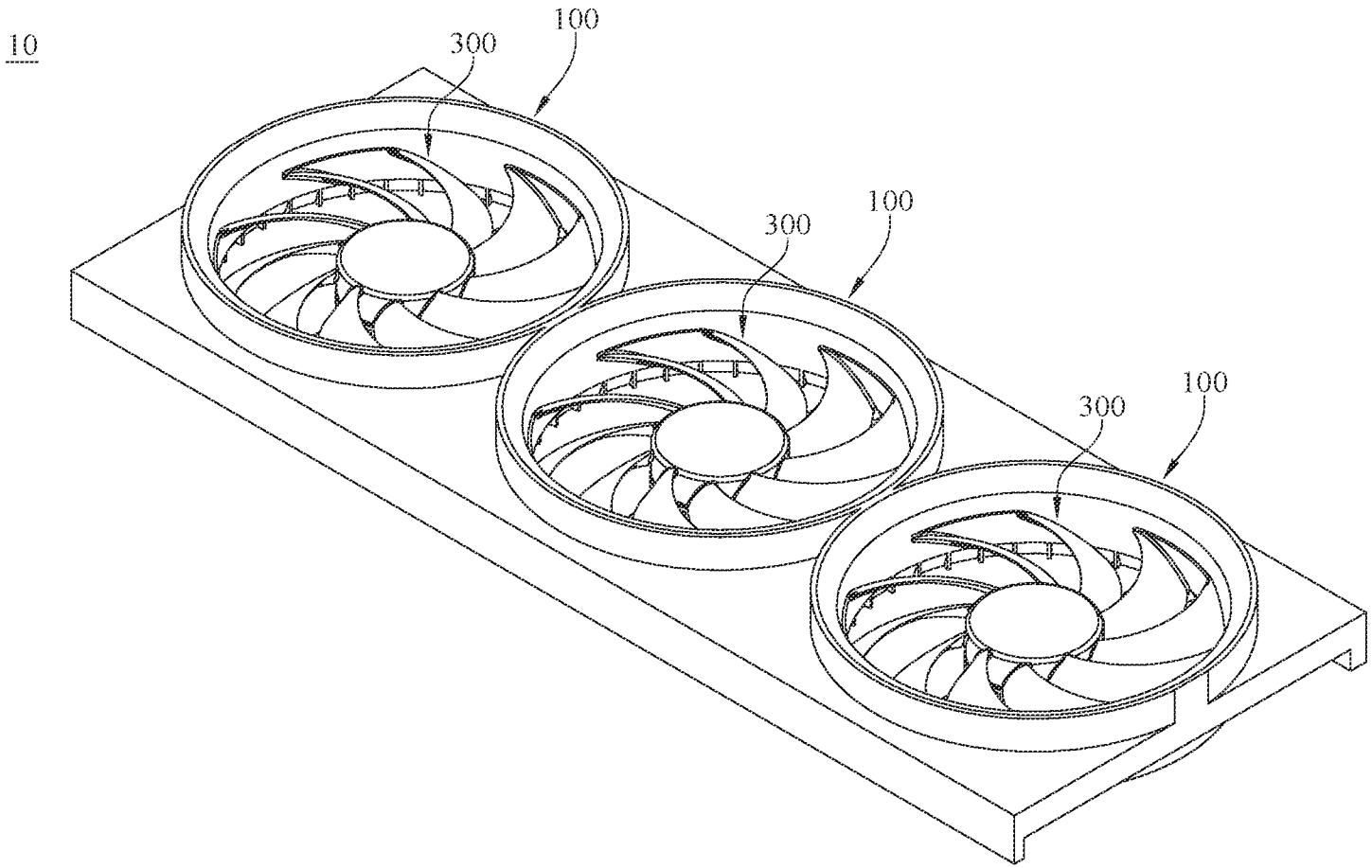
FIG. 1 is a perspective view of a fan assembly according to a first embodiment of the disclosure.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Figure 2:
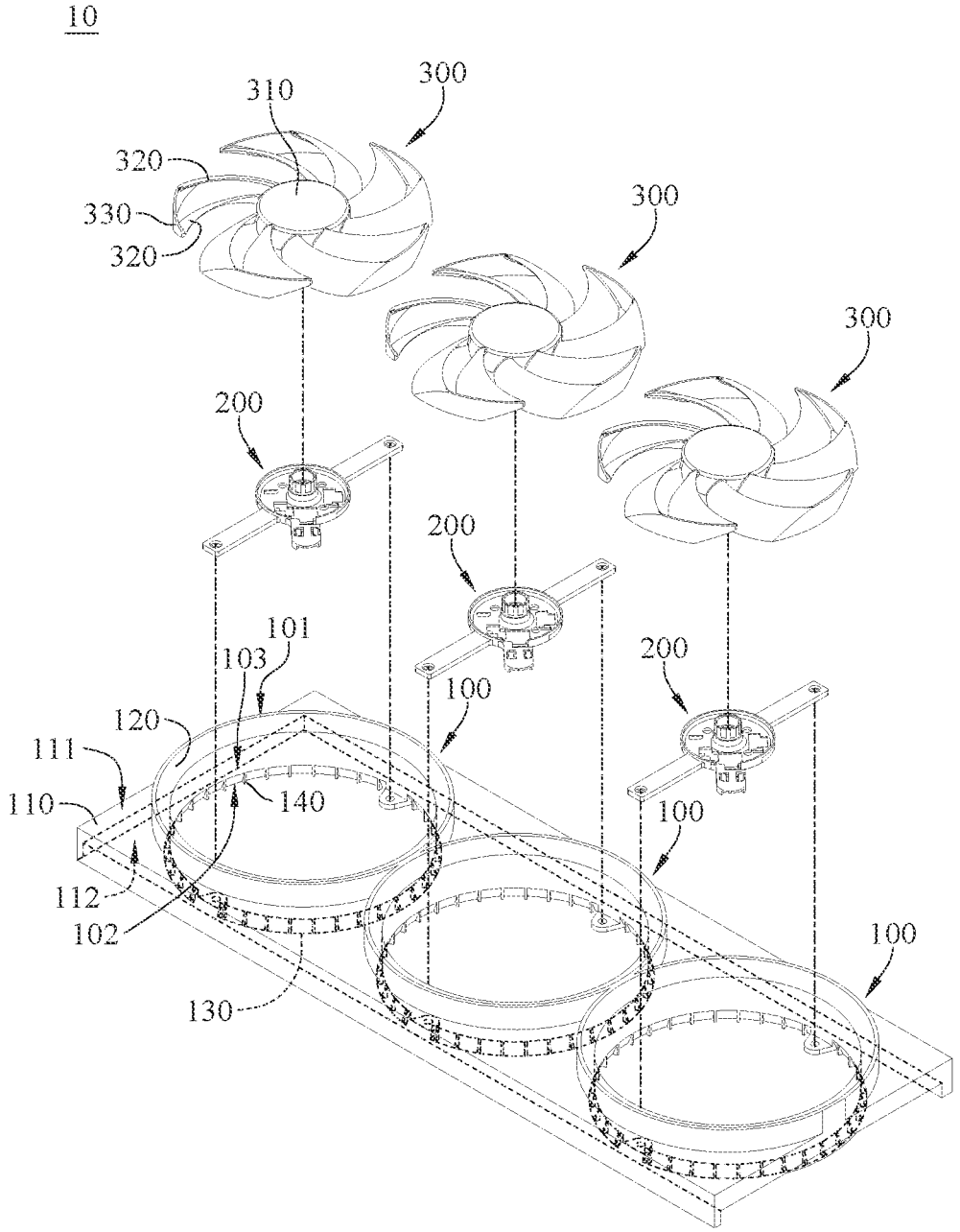
FIG. 2 is an exploded view of the fan assembly in FIG. 1.
Figure 3:
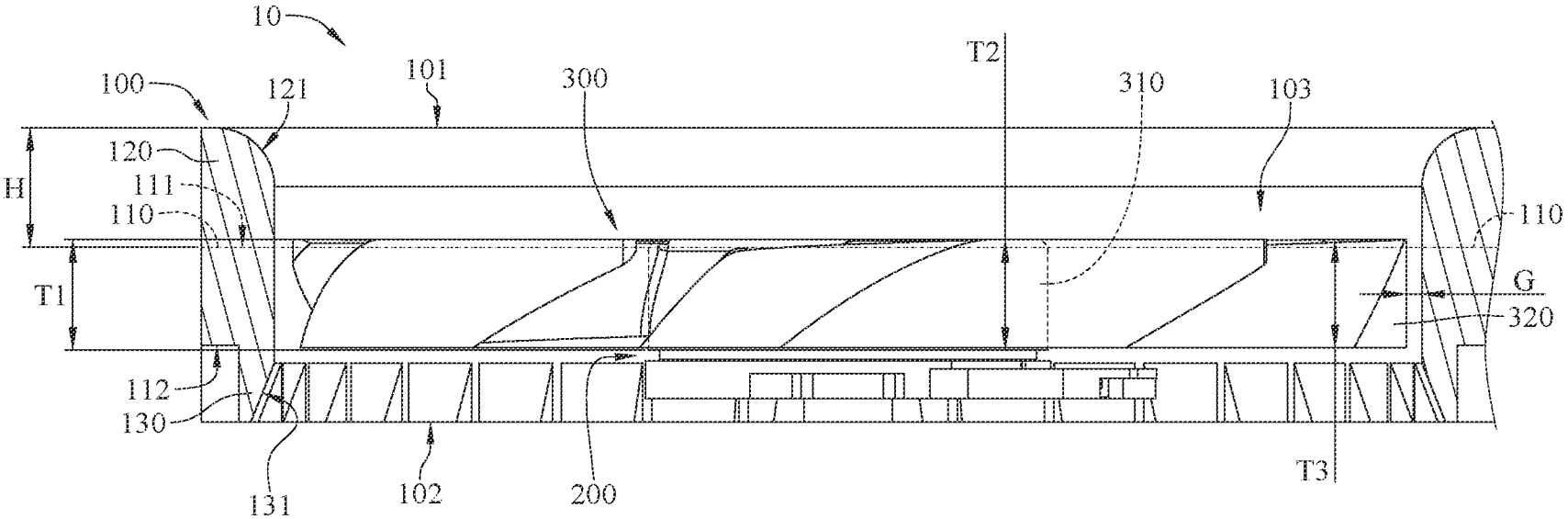
FIG. 3 is a partially enlarged side cross-sectional view of the fan assembly in FIG. 1.

Please refer to FIGS. 1 to 3, where FIG. 1 is a perspective view of a fan assembly according to a first embodiment of the disclosure, FIG. 2 is an exploded view of the fan assembly 10 in FIG. 1, and FIG. 3 is a partially enlarged side cross-sectional view of the fan assembly 10 in FIG. 1.

In this embodiment, the fan assembly 10 includes three fan frames 100, three rotation assemblies 200 and three impellers 300. The three fan frames 100 are, for example, integrally formed as a single piece. The three impellers 300 are disposed on the three fan frames 100 via the three rotation assemblies 200, respectively. Since the three fan frames 100, the three rotation assemblies 200 and the three impellers 300 are similar in structures and connection relationships, only one fan frame 100, one rotation assembly 200 and one impeller 300 that are corresponding to one another are described in detail hereinafter.

In this embodiment, the fan frame 100 includes a frame body 110, a first peripheral protruding plate 120, a second peripheral protruding plate 130 and a plurality of air guiding structures 140, and the fan frame 100 has an air inlet 101, an air outlet 102 and an air channel 103. Note that the first peripheral protruding plate 120 is configured to reduce the noise made by the fan frame 100, and the second peripheral protruding plate 130 is configured to guide an airflow blown by the impeller 300.

The frame body 110 has a first surface 111 and a second surface 112 facing away from each other. The first peripheral protruding plate 120 protrudes from the first surface 111 and is in, for example, a ring shape. The second peripheral protruding plate 130 protrudes from the second surface 112 and is in, for example, a ring shape. The first peripheral protruding plate 120, the frame body 110 and the second peripheral protruding plate 130 together form the air channel 103. The air inlet 101 is located at a side of the first peripheral protruding plate 120 that is located farthest away from the frame body 110. The air outlet 102 is located at a side of the second peripheral protruding plate 130 that is located farthest away from the frame body 110. The air inlet 101 is in fluid communication with the air outlet 102 via the air channel 103. In this embodiment, the first peripheral protruding plate 120 has a rounded edge 121 that is located at the air inlet 101. That is, an end surface of the first peripheral protruding plate 120 that is located farthest away from the frame body 110 is in a rounded shape and tapers toward the frame body 110. In addition, in this embodiment, a protruding height H of the first peripheral protruding plate 120 relative to the first surface 111 of the frame body 110 ranges, for example, from 5 millimeters (mm) to 15 mm. In this embodiment, the second peripheral protruding plate 130 has an air guiding edge 131. The air guiding edge 131 is located at the air channel 103. The air guiding structures 140 are spaced apart from one another and protrude from the air guiding edge 131 toward the air channel 103. In this embodiment, there are, for example, 32 air guiding structures 140. In this embodiment, the air guiding edge 131 tapers away from the air outlet 102. That is, in this embodiment, a tapered portion is formed between the side of the air guiding edge 131 located closest to the air outlet 102 and the side of the air guiding edge 131 located farthest away from the air outlet 102, but the disclosure is not limited thereto. In other embodiments, as long as a diameter of a side of the air guiding edge located closest to the air outlet is larger than a diameter of a side of the air guiding edge located farthest away from the air outlet, a step portion instead of the tapered portion may be formed between the side of the air guiding edge located closest to the air outlet and the side of the air guiding edge located farthest away from the air outlet.

The rotation assembly 200 is disposed on the frame body 110. In this embodiment, the impeller 300 is located in the air channel 103 and includes a hub 310, a plurality of blades 320 and a plurality of peripheral connecting components 330. The blades 320 radially protrude from the hub 310. The peripheral connecting components 330 connect sides of two adjacent blades 320 located farthest away from the hub 310, respectively. The hub 310 is rotatably disposed on the frame body 110 via the rotation assembly 200.

Note that in other embodiments, the impeller may merely include one peripheral connecting component, and in such embodiments, this peripheral connecting component may connect sides of all of the blades of the impeller located farthest away from the hub. In still other embodiments, the impeller may not include the peripheral connecting component and the sides of the blades located farthest away from the hub may be spaced apart from one another.

In this embodiment, the protruding height H of the first peripheral protruding plate 120 relative to the frame body 110 ranges from 50 to 100 percent of an overall axial thickness T1 of the impeller 300. In other words, the protruding height H of the first peripheral protruding plate 120 relative to the frame body 110 is equal to or greater than a half of the overall axial thickness T1 of the impeller 300 and is equal to or smaller than the overall axial thickness T1 of the impeller 300. Specifically, in this embodiment, the protruding height H of the first peripheral protruding plate 120 relative to the frame body 110 is, for example, a half of the overall axial thickness T1 of the impeller 300.

Note that in this embodiment, an axial thickness T2 of the hub 310 is the same as an axial thickness T3 of the blades 320. Thus, in this embodiment, the overall axial thickness T1 of the impeller 300 is equal to the axial thickness T2 of the hub 310 and the axial thickness T3 of the blades 320, but the disclosure is not limited thereto. In other embodiments, the axial thickness of the blades may be larger than the axial thickness of the hub, and in such embodiments, the overall axial thickness of the impeller is equal to the axial thickness of the blades. Alternatively, in still other embodiments, the axial thickness of the hub may be larger than the axial thickness of the blades, and in such embodiments, the overall axial thickness of the impeller is equal to the axial thickness of the hub.

Further, in this embodiment, the axial thickness T2 of the hub 310 ranges, for example, from 10 mm to 10.2 mm. In this embodiment, the impeller 300 and the frame body 110 are spaced apart from each other by a gap distance G, and the gap distance G ranges, for example, from 3 mm to 3.5 mm.

Note that the first peripheral protruding plate according to this disclosure is not limited to including the rounded edge located at the air inlet. Please refer to FIG. 4 that is a partially enlarged side cross-sectional view of a fan assembly 10*a* according to a second embodiment of the disclosure. Note that the main difference between the fan assembly 10*a* according to this embodiment and the fan assembly 10 according to the first embodiment in FIGS. 1 to 3 is that the first peripheral protruding plate 120*a* of the fan frame 100*a* of the fan assembly 10*a* includes a bevel edge 122*a* located at the air inlet 101*a* instead of the rounded edge 121 according to the first embodiment in FIG. 3. In other words, in this embodiment, an end surface of the first peripheral protruding plate 120*a* located farthest away from the frame body 110*a* is in an inclined shape and tapers toward the frame body 110*a*. In addition, the remaining features of the fan frame 100*a* of the fan assembly 10*a* according to this embodiment are the same as or similar to those of the fan frame 100 of the fan assembly 10 according to the first embodiment in FIGS. 1 to 3, and the fan assembly 10*a* according to this embodiment may include the rotation assembly 200 and the impeller 300 in FIGS. 1 to 3, and thus the repeated descriptions are omitted.

Note that in other embodiments, the fan frame of the fan assembly may not include the second peripheral protruding plate 130 and the air guiding structures 140.

Figure 4:
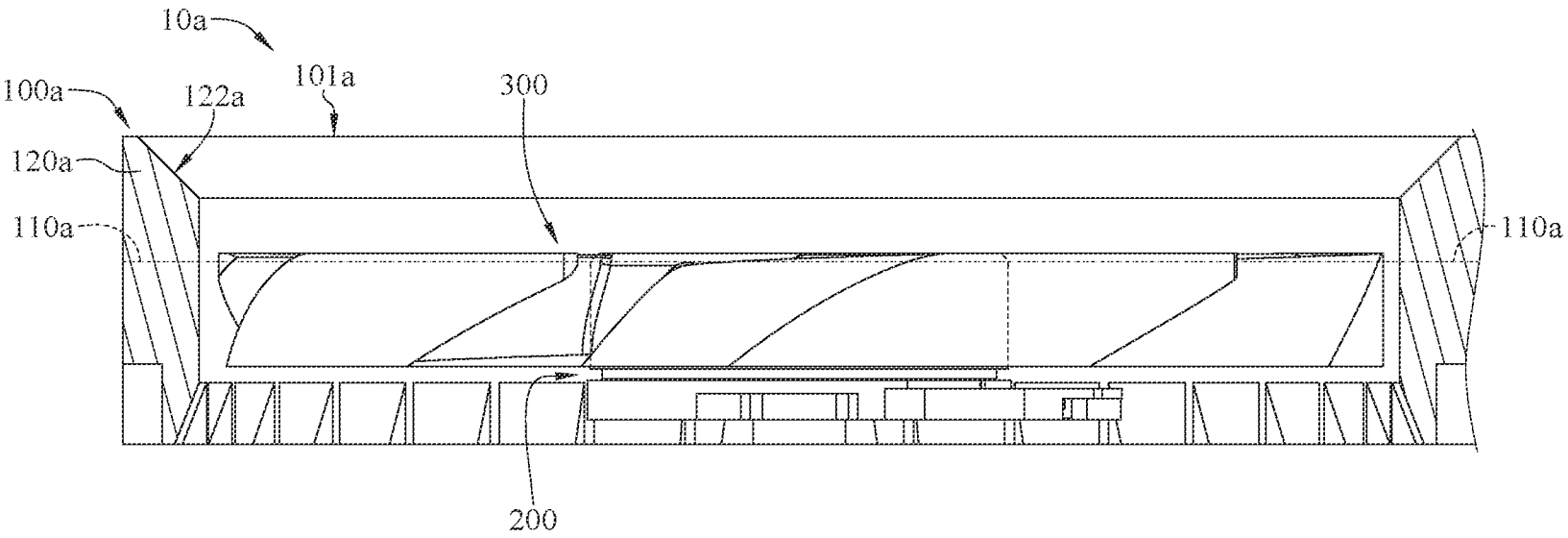
FIG. 4 is a partially enlarged side cross-sectional view of a fan assembly according to a second embodiment of the disclosure.

In addition, after performing several experiments, the inventors have found that with respect to the conventional fan assembly where the air inlet of the fan frame is flush with the outer surface of the fan frame and no rounded edge or bevel edge is formed at the air inlet, in making a noise of 26 dBA, the outlet air volume is 87.8 cube feet per minute (cfm), the static pressure is 1.11 $mmH_2O$, and the fan speed of the impeller is 2050 revolution per minute (RPM); with respect to the fan assembly 10 according to the first embodiment in FIG. 1, in making a noise of 26 dBA, the outlet air volume is 118 cfm, the static pressure is 1.4 $mmH_2O$, and the fan speed of the impeller is 2200 RPM; with respect to the fan assembly 10*a* according to the second embodiment in FIG. 4, in making a noise of 26 dBA, the outlet air volume is 104.8 cfm, the static pressure is 1.39 $mmH_2O$, and the fan speed of the impeller is 2200 RPM. According to the above experimental data, the first peripheral protruding plate according to the disclosure and the rounded edge or the bevel edge according to the disclosure increase the outlet air volume of the fan assembly, and thus higher fan speed is allowed to be used when the fan assembly makes the same level of noise. In other words, the fan assembly according to the disclosure is allowed to used lower fan speed to reach the desired outlet air volume, thereby reducing the noise made by the fan assembly. Note that the inlet air volume denotes the amount of the air flowing through the air inlet in a certain period, and the outlet air volume denotes the amount of the air flowing through the air outlet in a certain period.

According to the fan assembly disclosed by the above embodiments, since the protruding height of the first peripheral protruding plate relative to the fan frame ranges from 50 to 100 percent of the overall axial thickness of the impeller, and the air inlet is located on the side of the first peripheral protruding plate that is located farthest away from the frame body, the inlet air volume and the outlet air volume of the fan assembly are increased. Accordingly, the fan assembly is allowed to used lower fan speed to reach the desired inlet air volume and the desired outlet air volume, thereby reducing the noise made by the fan assembly.

It will be apparent to those skilled in the art that various modifications and variations can be made to the present disclosure. It is intended that the specification and examples be considered as exemplary embodiments only, with a scope of the disclosure being indicated by the following claims and their equivalents.

What is claimed is:

1. A fan assembly, comprising:

a fan frame, comprising a frame body and a first peripheral protruding plate and having an air inlet and an air outlet, wherein the first peripheral protruding plate protrudes from a side of the frame body and forms an air channel together with the frame body, the first peripheral protruding plate is configured to reduce a noise made by the fan assembly, the air inlet is located at a side of the first peripheral protruding plate located farthest away from the frame body, the air outlet is located at a side of the frame body located farthest away from the first peripheral protruding plate, and the air inlet is in fluid communication with the air outlet via the air channel; and an impeller, rotatably disposed on the frame body and located in the air channel;

wherein, a protruding height of the first peripheral protruding plate relative to the frame body ranges from 50 to 100 percent of an overall axial thickness of the impeller.

2. The fan assembly according to claim 1, wherein the protruding height of the first peripheral protruding plate relative to the frame body is a half of the overall axial thickness of the impeller.

3. The fan assembly according to claim 1, wherein the first peripheral protruding plate has a rounded edge located at the air inlet.

4. The fan assembly according to claim 1, wherein the first peripheral protruding plate has a bevel edge located at the air inlet.

5. The fan assembly according to claim 1, wherein the fan frame further comprises a second peripheral protruding plate and a plurality of air guiding structures, the second peripheral protruding plate is configured to guide an airflow blown by the impeller, the frame body has a first surface and a second surface facing away from each other, the first peripheral protruding plate protrudes from the first surface, the second peripheral protruding plate protrudes from the second surface, the first peripheral protruding plate, the frame body and the second peripheral protruding plate together form the air channel, the air outlet is located at a side of the second peripheral protruding plate located farthest away from the frame body, the second peripheral protruding plate has an air guiding edge, the air guiding edge is located at the air channel, and the plurality of air guiding structures are spaced apart from one another and protrude from the air guiding edge toward the air channel.

6. The fan assembly according to claim 5, wherein the air guiding edge tapers away from the air outlet.

7. The fan assembly according to claim 1, wherein the impeller comprises a hub, a plurality of blades and a plurality of peripheral connecting components, the plurality of blades protrude from the hub, the plurality of peripheral connecting components connect sides of two adjacent ones of the plurality of blades located farthest away from the hub, and the hub is rotatably disposed on the frame body.

8. The fan assembly according to claim 1, wherein the impeller comprises a hub and a plurality of blades, the plurality of blades protrude from the hub, the hub is rotatably disposed on the frame body, and an axial thickness of the hub is equal to an axial thickness of the plurality of blades.

9. The fan assembly according to claim 1, wherein the impeller comprises a hub and a plurality of blades, the plurality of blades protrude from the hub, the hub is rotatably disposed on the frame body, and an axial thickness of the hub ranges from 10 millimeters (mm) to 10.2 mm.

10. The fan assembly according to claim 1, wherein the protruding height of the first peripheral protruding plate relative to the frame body ranges from 5 mm to 15 mm.

* * * * *